United States Patent [19]

Bärnthaler et al.

[11] Patent Number: 4,688,855

[45] Date of Patent: Aug. 25, 1987

[54] DRIFT ADVANCING OR EXPLOITING MACHINE

[75] Inventors: Franz Bärnthaler, Weisskirchen; Eduard Krivec; Alfred Zitz, both of Zeltweg, all of Austria

[73] Assignee: Voest-Alpine Aktiengesellschaft, Linz, Austria

[21] Appl. No.: 823,112

[22] Filed: Jan. 27, 1986

[30] Foreign Application Priority Data

Jan. 29, 1985 [AT] Austria ..... 247/85

[51] Int. Cl.[4] ..... E21C 25/06

[52] U.S. Cl. ..... 299/75; 299/67; 299/76

[58] Field of Search ..... 299/64, 67, 71, 73–77

[56] References Cited

U.S. PATENT DOCUMENTS

| | | | |
|---|---|---|---|
| 2,659,585 | 11/1953 | McCallum | 299/75 |
| 2,695,164 | 11/1954 | Arentzen | 299/71 |
| 3,269,776 | 8/1966 | Munger | 299/67 |
| 3,302,974 | 2/1967 | Hlinsky | 299/75 |
| 3,314,722 | 4/1967 | Webster | 299/75 |
| 3,341,254 | 9/1967 | Arndt | 299/71 |
| 3,420,577 | 1/1969 | Pentith | 299/71 |
| 3,469,885 | 9/1969 | Marberg | 299/75 |

FOREIGN PATENT DOCUMENTS

| | | | |
|---|---|---|---|
| 0021987 | 1/1981 | European Pat. Off. . | |
| 941841 | 4/1956 | Fed. Rep. of Germany | 299/71 |
| 2050618 | 4/1972 | Fed. Rep. of Germany | 299/64 |
| 2430606 | 1/1976 | Fed. Rep. of Germany . | |
| 2558647 | 6/1977 | Fed. Rep. of Germany . | |
| 2240872 | 9/1977 | Fed. Rep. of Germany . | |
| 2621674 | 11/1977 | Fed. Rep. of Germany . | |
| 2727836 | 1/1978 | Fed. Rep. of Germany . | |
| 2458514 | 4/1978 | Fed. Rep. of Germany . | |
| 2813143 | 9/1979 | Fed. Rep. of Germany . | |

*Primary Examiner*—Stephen J. Novosad
*Assistant Examiner*—David J. Bagnell
*Attorney, Agent, or Firm*—Cushman, Darby & Cushman

[57] ABSTRACT

A mine drift advancing machine includes a cutting arm pivoted at its rear end to the machine chassis for movement about a horizontal axis and at its front end supporting a carrier which is pivoted to the arm for movement about a vertical axis. At least two horizontally spaced apart rocking levers are pivoted at their rear ends to the carrier for swinging about vertical axes and a lever drive is provided for swinging the levers simultaneously in the same directions. The forward end of each lever carrie at least one cutting tool which is rotatable about a generally vertical axis.

30 Claims, 5 Drawing Figures

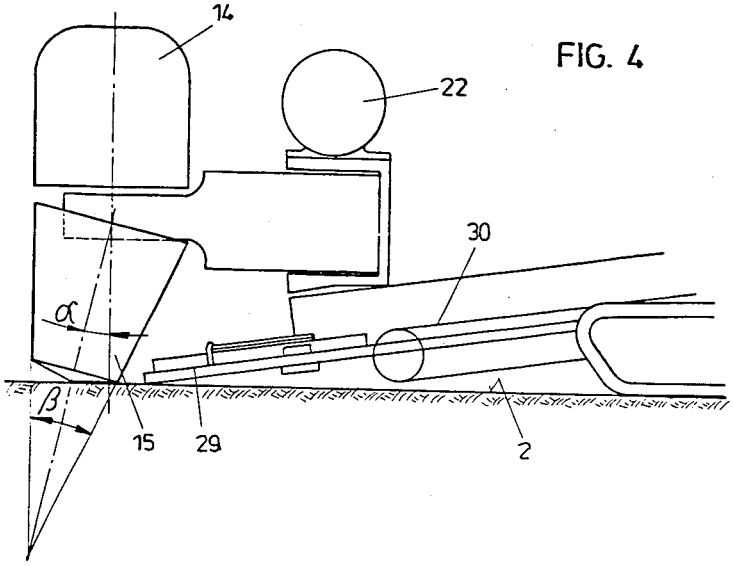
FIG. 4
FIG. 5
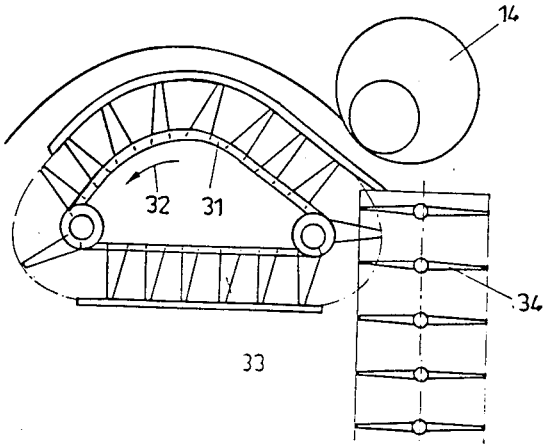

DRIFT ADVANCING OR EXPLOITING MACHINE

BACKGROUND OF THE INVENTION

1. Field of the Invention

The invention refers to a drift advancing or exploiting machine in particular equipped with a caterpillar chassis and comprising a cutting arm on which are arranged cutting heads and/or cutting rolls rotatably supported for being rotated around an axis transversely oriented relative to the advancing direction.

2. Description of the Prior Art

In usual cutting machines of the initially mentioned type, the cantiliever arm or cutting arm, respectively, is supported on a caterpillar chassis for being swivellable around a substantially vertical axis and around a substantially horizontal axis. For making excavations of greater cross section, the cantilever arm must be given a correspondingly great length, so that, when swivelling the cantilever arm in lateral direction or in height direction, there results an essentially arcuate mining face. In case of fragile mine roof, it is necessary to establish the provisional consolidation of the drift near the mine face for preventing collapsing of the mine roof. Such a provisional consolidation is relatively expensive and time-consuming and can, with consideration of the lateral swivellable cutting arm, not be advanced arbitrarily close to the mine face. Furthermore, such a provisional consolidation requires correspondingly expensive devices for transporting the consolidating frames and auxiliary equipment for erecting the consolidation above the cutting machine being operated in front of the mine face and the space at disposal within the area near the mine face is correspondingly restricted. Furthermore, with known devices it is only possible to erect the drift consolidation adjacent the drift face only when stopping the cutting work, because a reliable protecting means can not be arranged between the cutting tools and locations located adjacent the drift face, because this protecting means would collide with the universally swivellable cutting arm.

SUMMARY OF THE INVENTION

The invention now aims at providing a device of the initially mentioned type, which allows to erect the consolidation of the drift and thus to secure the drift near the mine face without interrupting the cutting work and which allows to make the mine face a plane face as far as possible. For solving this task, the device according to the invention essentially consists in that a carrier extending transversely to the cutting arm and in parallel relation to the drift floor is swivellably linked to the end of the cutting arm, which is swivellable only in height direction, for swivelling movement around an axis extending transversely to the cutting arm and in parallel relation to the drift floor and is guided in its parallel condition by a parallel guide, in that at least two rocking levers, which are swivellable around axes vertically extending relative to the drift floor, are linked to the carrier at a mutual distance extending in parallel relation to the drift floor and have on their free ends supported the cutting heads for rotation around axes extending approximately vertically relative to the drift floor, in that the rocking levers are driven by a swivel drive for being swivelled in the same sense and in that one rocking lever each is linked to the outer ends of the carrier parallely extending relative to the drift floor. The cutting heads or cutting rolls, respectively, are swivellable only over part of the excavation area on the rocking levers being arranged one beside the other at distances extending in parallel relation relative to the drift floor, so that the whole drift face can be cut with short rocking levers being substantially shorter than the cutting arm. The carrier swivellably supporting the rocking levers can thus come till very near the drift face. On account of the cutting arm, which has linked to its ends the carrier carrying the rocking levers, being only swivellable in height direction, the cutting arm represents no obstacle for positioning consolidating frames. In case of a fragile drift roof, consolidating frames can be positioned till near the carrier linked to the free end of the cutting arm, so that the advanced drift can be consolidated till near the drift face. In this manner, it is made possible to effect consolidating work in front of the cutting machine during operation of the cutting machine and immediately before the drift face, so that the drift advancing speed and operational safety is increased. On account of one rocking lever each being linked to the outer ends of the carrier extending in parallel relation of the drift floor, these rocking lever can be swivelled for a considerable angle without colliding with the carrier. On account of the carrier, which has linked thereto the rocking levers, being connected with the end of the cutting arm by means of a parallel guide, it is made possible that the axes, which vertically extend relative to the drift floor, of the cutting heads or cutting rolls, maintain their approximately vertical position relative to the drift floor over the whole vertical swivelling path of the cutting arm, so that the drift face can be cut approximately vertically relative to the drift floor.

According to the invention, the arrangement is conveniently selected such that the swivelling pathes of the cutting heads and/or cutting rolls rotatably supported on two adjacent rocking levers overlap one another, so that the excavating area can better be cut over its whole width. In this manner, any vaulting of the excavating area in horizontal direction and transversely to the longitudinal axis of the drift is reduced to a considerable extent.

According to a preferred embodiment of the invention, two cutting heads arranged at both sides of the rocking lever are rotatably supported on each rocking lever one above the other for being rotated around the axes extending approximately vertically relative to the drift floor, noting that the parallel guide of the carrier has, in this case, a particularly pronounced effect.

In this case and according to the invention, the axes of the cutting heads located one above the other are inclined one relative to the other in drift advancing direction, noting that at least one cutting head has the shape of a truncated cone. In usual arrangements, a gap exists between two cutting heads, said gap corresponding to the width of the arm carrying the cutting heads and rotatably supporting same. This gap is the cause for a remaining rock rib, the removal of which is laboursome. On account of the axes of the cutting heads or cutting rolls being inclined one relative to the other in forward direction, such a gap and thus such a mentioned rock rib can be avoided or be reduced. According to the invention, the arrangement is preferably selected such that one cutting head, in particular the upper cutting head, is essentially cylindrical in shape and has its axis vertically extending relative to the drift floor and that one cutting head, in particular the lower cutting head, has essentially the shape of a truncated cone and has its axis forwardly inclined in drift advancing direction. In this manner, the gap at the front side is avoided for the greatest part by the obliquely positioned lower cutting hear having the shape of a truncated cone. A face vertically extending relative to the floor is cut by the upper cutting head being cylindrically designed. On account of the lower cutting head having the shape of a truncated cone and on account of the generatrix of this truncated cone being at the front side in alignment with the generatrix of the upper cylindrical cutting head, cutting of the drift face along a plane surface is made possible. The area of transition to the drift roof becomes rounded on account of the upper cylindrical cutting hear being, according to the invention, given a chamferred or rounded edge. Conveniently, a conical part is adjoining the cone of the lower cutting head, so that also at the area of transition between the drift face and drift floor there results a chamferred or rounded area.

In an arrangement comprising two rocking levers there results, as a whole, a drift face which has the shape of a double vault vertically extending relative to the drift floor.

Individual vaults are cut by the cutting heads arranged on the rocking levers. The cut material shall be removed from these vaults. Therefore and according to the invention, there are conveniently provided conveying means which extend in correspondence to the cutting pathes of the cutting heads or cutting rolls. In an arrangement comprising two rocking levers, the conveying means are conveniently formed of scraper conveyors, the scrapers of which are moved in direction to the central area of the drift face at the drift face, noting that the scrapers of the scraper conveyors located beneath the adjacent cutting heads or cutting rolls are in meshing engagement with the scrapers of a centrally arranged removal conveyor means. In this manner, the cut material is removed from the vaults to the central area and fed to a usual removal conveyor means.

BRIEF DESCRIPTION OF THE DRAWING

In the drawing, the invention is schematically illustrated with reference of an embodiment.

In the drawing:

FIG. 4 shows a pair of cutting heads in detail and FIG. 5 shows the arrangement of a scraper conveyor.

DETAILED DESCRIPTION OF THE PREFERRED EMBODIMENT

Figure 1:
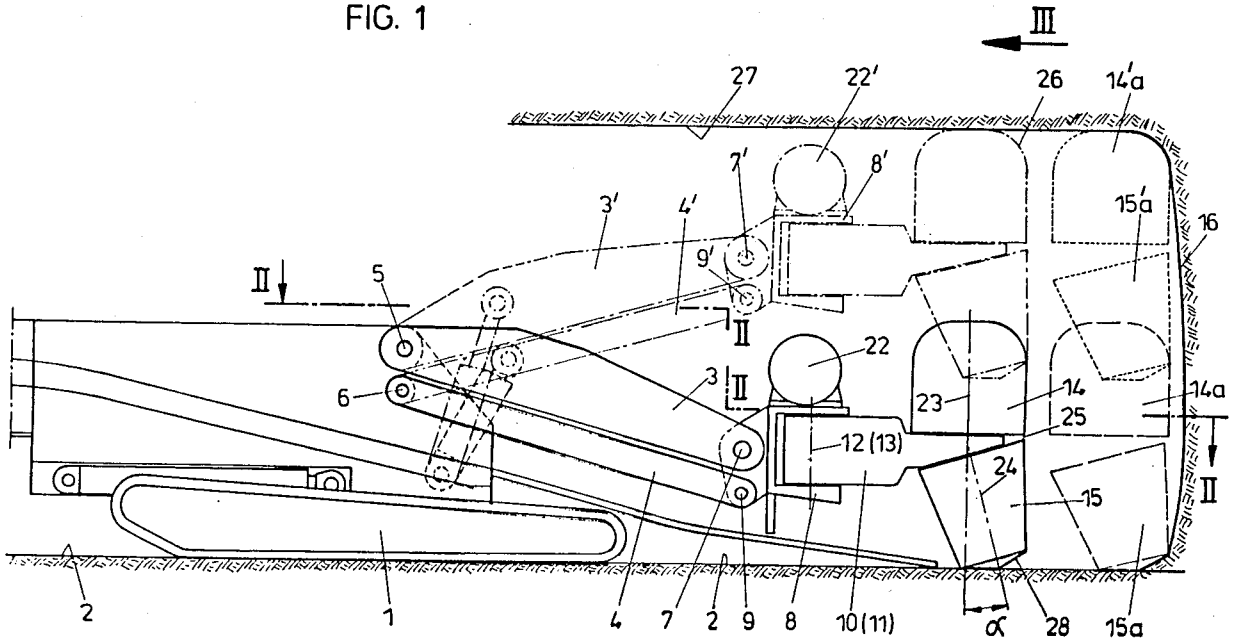
FIG. 1 shows a side elevation of the cutting machine.
Figure 2:
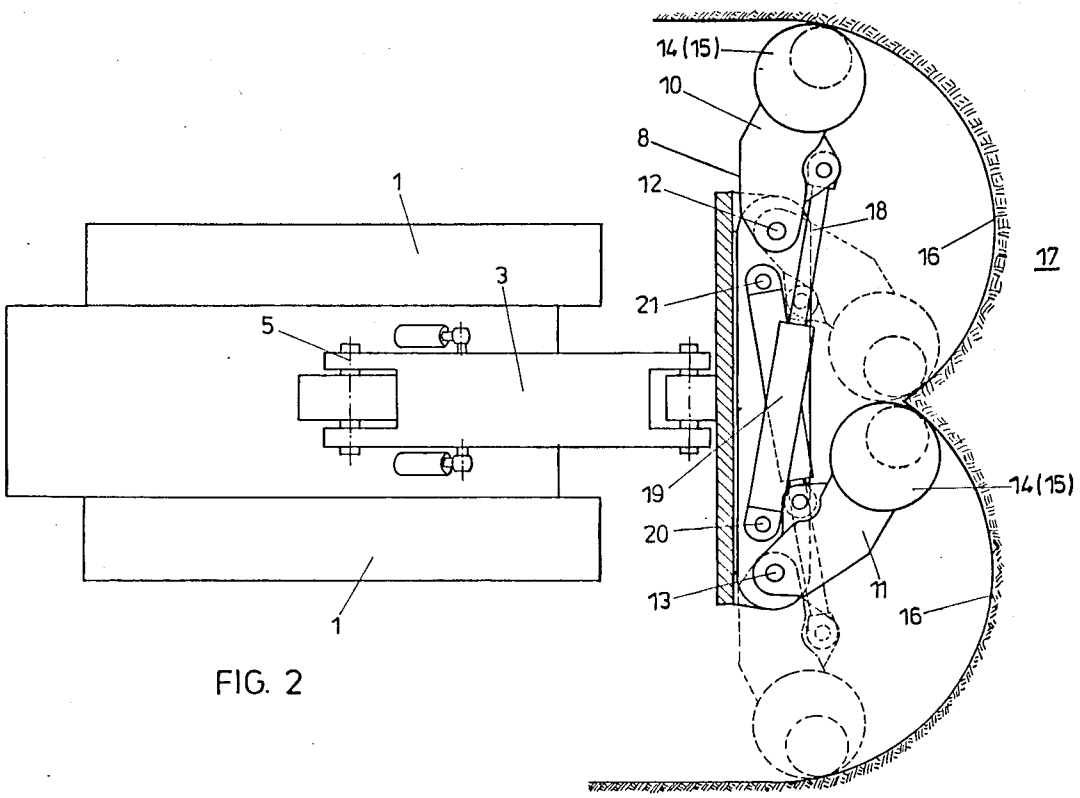
FIG. 2 shows a top plan view along line II—II—II—II of FIG. 1.
Figure 3:
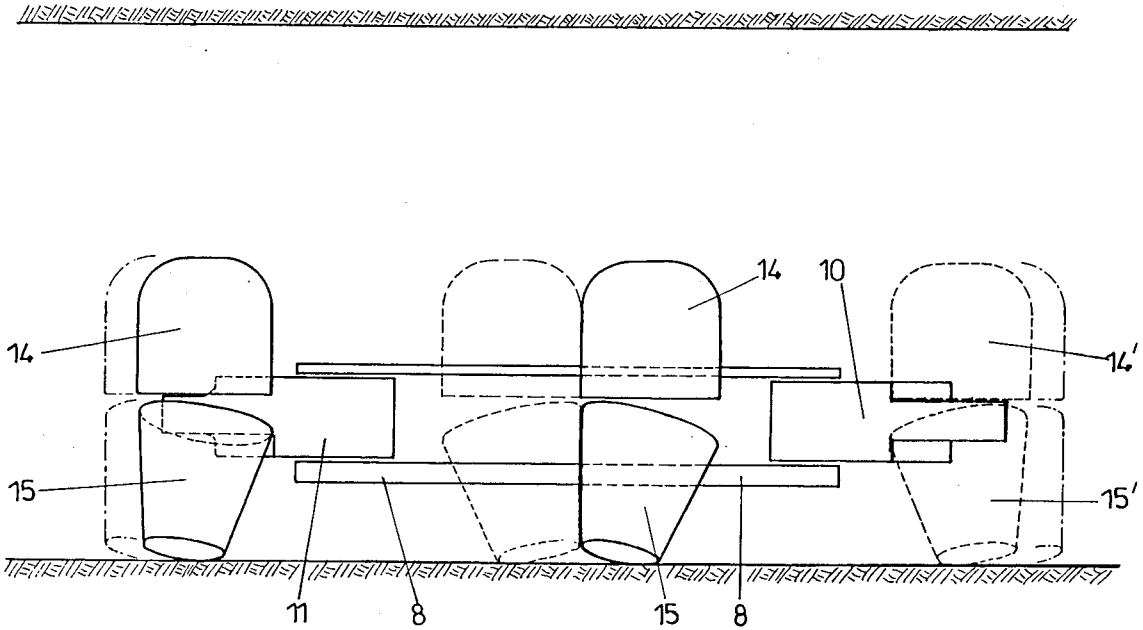
FIG. 3 shows a front view of the cutting machine in direction of the arrow III of FIG. 1.

Two arms 3 and 4 are linked for being swivellable in height direction on the frame of the cutting machine which is movable on caterpillars 1 along the floor 2. The arm 3 is linked to the cutting machine for being swivelled around a horizontal axis 5 and the arm 4 is linked to the cutting machine for swivelling movement around a horizontal axis 6, so that these arms 3 and 4 can only be swivelled in height direction. Said arm 3 forms the cutting arm. A carrier 8 is linked to the cutting arm 3 via an axis 7 parallely extending relative to the drift floor, the carrier 8 being rotatable around the axis 7. Also the cutting arm 4 is linked to this carrier 8 via an axis 9 extending in parallel relation to the floor. In this manner, the cutting arms 3 and 4 form a parallel guide for the carrier 8. In the lifted position, the cutting arm 3 arrives at the position 3' and the cutting arm 4 arrives at the position 4', the axes 7 and 9 thereby arriving at the positions 7', 9' and the carrier 8 arriving at the position 8'.

Two rocking levers 10 and 11 are arranged on the carrier 8 for being swivelled around axes 12 and 13 vertically extending relative to the drift floor. At the end of said both levers, two cutting heads 14 and 15 are rotatably supported for being rotated about axes extending approximately vertically relative to the drift floor. The rocking levers 10 and 11 are driven for performing a swivelling movement in the same sense, so that approximately cylindrical profiles 16 are cut into the drift face 17. The swivelling paths of the cutting heads 14, 15 overlap one another and the distance between the axes 12 and 13, viewed in a direction parallel to the drift floor, is smaller than half the width of the mine face. The swivel drive is formed of a thrust piston drive means 18 and 19 acting on the levers 10 and 11 and being linked to the carrier 8 at 20 and 21. The cutting heads 14, 15 are driven by two electromotors 22. A gearing unit, not shown, transmits the rotational movement via the swivel point of the associated rocking lever to the cutting head axes. The sense of rotation and the rotating speed of the cutting heads can thus be adjusted within the rocking lever itself by means of a simple spur wheel gearing. On account of incorporating the gearing unit into the rocking levers, the cutting heads can be given a small diameter.

The upper cutting head 14 is cylindrical in shape and rotatably supported on the rocking levers for being rotated around an axis 23 vertically extending relative to the drift floor. The lower cutting head 15 is designed as a truncated cone and rotatably supported on the rocking lever 10 or 11, respectively, for being rotated around an axis 24 inclined in forward direction. The angle $\alpha$ of inclination of the axis 24 relative to the vertical axis 23 corresponds to half of the pointed angle $\beta$ (FIG. 4) of the conical shape of the cutting head 15, so that, at the drift face, the generatrices of the cutting head 14 and of the cutting head 15 are aligned along a straight line. In this manner, the drift face is vertically cut, because on account of the parallel guide for the carrier 8 movement of the cutting heads 14, 15 is effected in vertical direction. On account of the inclined position of the axis 24, there results between the cutting heads 14 and 15 a negligible small gap 25 at the drift face, so that there remain no rock ribs or only very narrow rock ribs. On account of the rocking levers 10, 11 being driven in the same sense, the paths of movement of the cutting heads 14, 15 of the rocking lever 10 and the rocking lever 11 may overlap one another, so that the drift face can completely by cut. The cut drift face 16-16 is shown in the position as having been cut by the cutting heads 14, 15 in their advanced position **14*a*, 15*a***.

The upper cutting head 14 is cylindrical in shape but has, however, a rounded portion 26 at the upper edge. In this manner, a rounded area of transition between the drift face 16 and the drift roof 27 and between the side walls of the drift and the roof 27 is obtained. A cone 28 or a similar rounded portion is adjoining the cone of the lower cutting head 15, so that also the area of transition to the drift floor is chamferred.

During cutting work, the cutting machine is advanced on the caterpillar 1 and the cutting heads arrive then at the advanced positions 14*a* and 15*a*.

FIG. 4 shows the cutting heads 14, 15 in their lowermost position at the drift floor 2. A loading ramp 29 comprising a conveyor 30 extends behind these cutting heads. As is shown in FIG. 5, a scraper conveyor 31 is adapted to the portions, which have the shape of a segment of a circle, of the drift face 16, the conveying direction of this conveyor being indicated by an arrow 32. The teeth 33 of this scraper conveyor 31 move the cut material to the central area, noting that within the central area the teeth 33 of the right hand scraper conveyor and the left hand scraper conveyor, respectively, are in meshing engagement with the webs of a centrally arranged scraper conveyor 34. In this manner, the cut material is transported away.

What is claimed is:

1. A drift advancing or exploiting machine movable along a mine floor comprising:

a chassis having a longitudinal horizontal axis;

a cutting arm having a forward end and a rear end which is pivoted to the chassis for swinging movement only about a horizontal axis which is transverse to the longitudinal axis of the chassis;

a carrier pivoted to the forward end of the cutting arm for swinging movement relative said arm about a horizontal axis transverse to the chassis axis, said carrier extending laterally of the cutting arm and parallel to the mine floor;

guide means for maintaining the carrier parallel to the mine floor when said cutting arm swings about its horizontal pivot axis;

at least two horizontally spaced apart rocking levers extending parallel to the mine floor, each lever having an inner end and an outer end, the inner ends being pivoted to said carrier for swinging movement about vertical axes;

drive means for swinging the rocking levers independently in the same direction about their pivot axes;

and at least one cutting tool supported by the outer end of each rocking lever for rotation about a generally vertical axis.

2. A machine as in claim 1 wherein said rocking levers are so mounted that the cutting heads on two adjacent levers have swing paths which overlap one another.

3. A machine as in claim 2 wherein there are only two rocking levers and wherein the horizontal distance between the pivot axes of the levers is less than half the width of a mine face to be cut by said cutting tools.

4. A machine as in claim 2 wherein there is a pair of cutting tools rotatably mounted on each rocking lever, one cutting tool of each pair being arranged above the other cutting tool of the same pair.

5. A machine as in claim 4 wherein the axis of rotation of at least one cutting tool of each pair is angled in the drift-advancing direction relative to said generally vertical axis and wherein at least one cutting tool has the shape of a truncated cone.

6. A machine as in claim 4 wherein the uppermost cutting tool of at least one pair is substantially cylindrical and rotates about said generally vertical axis and wherein the lowermost cutting tool of the same pair is a truncated cone and rotates about an axis angled in the drift advancing direction relative to said generally vertical axis.

7. A machine as in claim 6 wherein the angle $\alpha$ between said generally vertical axis and said angled axis is half the angle $\beta$ of the side of the truncated cone.

8. A machine as in claim 6 wherein the lowermost cutting tool has a lower end portion which is conical.

9. A machine as in claim 6 wherein the uppermost cutting tool has an upper end which is rounded or chamferred.

10. A machine as in claim 6 wherein the uppermost cutting tool has an upper end which is rounded or chamferred.

11. A machine as in claim 1 including conveyor means for conveying material cut by said cutting tools, said conveyor means extending along paths corresponding to the paths traversed by said cutting tools during swinging of said rocking levers.

12. A machine as in claim 11 wherin there are only two rocking levers, the conveyor means being formed of scraper conveyors, the scrapers of which are moved in direction to the central area of the drift face at the drift face, the scrapers of the scraper conveyors located below the adjacent cutting tools being in meshing engagement within the central area with a removal conveyor means arranged centrally of the machine.

13. A drift advancing or exploiting machine movable along a mine floor comprising:

a chassis having a longitudinal horizontal axis;

a cutting arm having a forward end a rear end which is pivoted to the chassis for swinging movement only about a horizontal axis which is tranverse to the longitudinal axis of the chassis;

a carrier pivoted to the forward end of the cutting arm for swinging movement relative said arm about a horizontal axis transverse to the chassis axis, said carrier extending laterally of the cutting arm and parallel to the mine floor;

guide means for maintaining the carrier parallel to the mine floor when said cutting arm swings about its horizontal pivot axis;

at least two horizontally spaced apart rocking levers extending parallel to the mine floor, each lever having an inner end and an outer end, the inner ends being pivoted to said carrier for swinging movement about vertical axes;

drive means for swinging the rocking levers independently in the same direction about their pivot axes;

at least one cutting tool supported by the outer end of each rocking lever for rotation about a generally vertical axis; and conveyor means for conveying material cut by said cutting tools, said conveyor means extending along paths corresponding to the paths traversed by said cutting tools during swinging of said rocking levers.

14. A machine as in claim 13 wherein said rocking levers are so mounted that the cutting heads on two adjacent levers have swing paths which overlap one another.

15. A machine as in claim 14 wherein there are only two rocking levers and wherein the horizontal distance between the pivot axes of the levers is less than half the width of a mine face to be cut by said cutting tools.

16. A machine as in claim 15 wherein the axis of rotation of at least one cutting tool of each pair is angled in the drift-advancing direction relative to said generally vertical axis and wherein at least one cutting tool has the shape of a truncated cone.

17. A machine as in claim 14 wherein there is a pair of cutting tools rotatably mounted on each rocking lever, one cutting tool of each pair being arranged above the other cutting tool of the same pair.

18. A machine as in claim 15 wherein the uppermost cutting tool of a least one pair is substantially cylindrical and rotates about said generally vertical axis and wherein the lowermost cutting tool of the same pair is a truncated cone and rotates about an axis angled in the drift advancing direction relative to said generally vertical axis.

19. A machine as in claim 18 wherein the angle $\alpha$ between said generally vertical axis and said angled axis is half the angle $\beta$ of the side of the truncated cone.

20. A machine as in claim 18 wherein the lowermost cutting tool has a lower end portion which is conical.

21. A machine as in claim 18 wherein the uppermost cutting tool has an upper end which is rounded or chamferred.

22. A machine as in claim 13 wherein there are only two rocking levers, the conveyor means being formed of scraper conveyors, the scrapers of which are moved in directin to the central area of the drift face at the drift face, the scrapers of the scraper conveyors located below the adjacent cutting tools being is meshing engagement within the central area with a removal conveyor means arranged centrally of the machine.

23. A drift advancing or exploiting machine movable along a mine floor comprising:

a chassis having a longitudinal horizontal axis;

a cutting arm having a forward end and rear end which is pivoted to the chassis for swinging movement only about a horizontal axis which is transverse to the longitudinal axis of the chassis;

a carrier pivoted to the forward end of the cutting arm for swinging movement relative said arm about a horizontal axis transverse to the chassis axis, said carrier extending laterally of the cutting arm and parallel to the mine floor;

guide means for maintaining the carrier parallel to the mine floor when said cutting arm swings about its horizontal pivot axis;

two horizontally spaced apart rocking levers extending parallel to the mine floor, each lever having an inner end and an outer end, the inner ends being pivoted to said carrier for swinging movement about vertical axes;

drive means for swinging the rocking levers simultaneously in the same direction about their pivot axes;

at least one cutting tool supported by the outer end of each rocking lever for rotation about a generally vertical axis; and conveyor means for conveying material cut by said cutting tools, said conveyor means extending along paths corresponding to the paths traversed by said cutting tools during swinging of said rocking levers, the conveyor means being formed of scraper conveyors, the scrapers of which are moved in direction to the central area of the drift face at the drift face, the scrapers of the scraper conveyors located below the adjacent cutting tools being in meshing engagement with the central area with a removal conveyor means arranged centrally of the machine.

24. A machine as in claim 23 wherein said rocking levers are so mounted that the cutting heads on the levers have swing paths which overlpa one another.

25. A machine as in claim 24 wherein the horizontal distance between the pivot axes of the levers is less than half the width of a mine face to be cut by said cutting tools.

26. A machine as in claim 24 wherein there is a pair of cutting tools rotably mounted on each rocking lever, one cutting tool of each pair being arranged above the other cutting tool of the same pair.

27. A machine as in claim 26 wherein the axis of rotation of at least one cutting tool of each pair is angled in the drift-advancing direction relative to said generally vertical axis and wherein at least one cutting tool has the shape of a truncated cone.

28. A machine as in claim 26 wherein the uppermost cutting tool of at least one pair is substantially cylindrical and rotates about said generally vertical axis and wherein the lowermost cutting tool of the same pair is a truncated cone and rotates about an axis angled in the drift advancing direction relative to said generally vertical axis.

29. A machine as in claim 28 wherein the angle $\alpha$ between said generally vertical axis and said angled axis is half the angle $\beta$ of the side of the truncated cone.

30. A machine as in claim 28 wherein the lowermost cutting tool has a lower end portion which is conical.

* * * * *